United States Patent [19]

Saegusa et al.

[11] 4,314,472

[45] Feb. 9, 1982

[54] METHOD FOR PRODUCING A MAGNETIC ROTATABLE MEMBER FOR AN ELECTROMAGNETIC CLUTCH

[75] Inventors: Nobuaki Saegusa; Masakatsu Sakaki; Genzo Yanai, all of Isesaki, Japan

[73] Assignees: Sankyo Electric Company Limited; Yanai Seiko Company Limited, both of Isesaki, Japan

[21] Appl. No.: 104,768

[22] Filed: Dec. 18, 1979

[30] Foreign Application Priority Data

Dec. 21, 1978 [JP] Japan ..... 53/158975

[51] Int. Cl.[3] ..... B21D 28/00

[52] U.S. Cl. ..... 72/341; 72/340; 72/348; 72/356; 29/148.4 C

[58] Field of Search ..... 72/335, 340, 327, 348, 72/356, 341; 29/148.3, 148.4 C; 192/84 C

[56] References Cited

U.S. PATENT DOCUMENTS

| | | | |
|---|---|---|---|
| 2,382,349 | 8/1945 | Taylor | 72/340 |
| 2,913,811 | 11/1959 | Bensen | 72/348 X |
| 3,138,864 | 6/1964 | Coen | 72/348 X |
| 3,191,421 | 6/1965 | Coen | 72/348 X |
| 3,204,323 | 9/1965 | Schaeffler | 29/148.4 C |
| 3,367,165 | 2/1968 | Coen | 72/348 |
| 3,412,593 | 11/1968 | Price | 72/340 |

*Primary Examiner*—Leon Gilden

*Attorney, Agent, or Firm*—Hopgood, Calimafde, Kalil, Blaustein & Judlowe

[57] ABSTRACT

A method for producing a magnetic rotatable member as a part of a pulley in an electromagnetic clutch is proposed. In order to reduce the producing time and the wasted material amount, the rotatable member is formed by press-drawing a magnetic circular plate to form an annular body consisted of an outer annular cylindrical portion, an inner annular cylindrical portion and an axial end annular plate portion connecting therebetween. Thereafter, the blank is subjected to ironing to form a radial annular rim on the outer surface of the outer annular cylindrical portion at the axial end, and also subjected to cutting-away and bending processes to cut away the outer edge of the inner annular cylindrical portion and to bend the resultant annular thin wall portion radially inwardly so that a radial flange is formed. The resultant magnetic rotatable member has an annular portion defined by the three portions in which an electromagnet should be stationarily contained, the radial annular rim for increasing the magnetic friction surface area and the radial flange for a stopper of a bearing on which the rotatable member should be mounted. The magnetic rotatable member has a high accurate dimension without machining.

3 Claims, 15 Drawing Figures

METHOD FOR PRODUCING A MAGNETIC ROTATABLE MEMBER FOR AN ELECTROMAGNETIC CLUTCH

BACKGROUND OF THE INVENTION

This invention relates to electromagnetic clutches and, in particular, to a method for producing a magnetic rotatable member in such an electromagnetic clutch.

An electromagnetic clutch which is mounted on a device having a drive shaft to selectively drive the device by an external power source has been known and used in the prior art, as disclosed in, for example, U.S. Pat. Nos. 3,044,594, 3,082,933, and others.

Such an electromagnetic clutch comprises a magnetic pulley rotatably mounted on a housing of the device and being rotated by an external power source through a belt, and an armature plate fixed onto the drive shaft of the device. An electromagnetic coil or an electromagnet associates with the pulley to magnetically attract the armature plate to the pulley at a time when being energized so that the rotation of the pulley is transmitted to the drive shaft. Furthermore, the pulley is provided with an annular hollow portion in which the electromagnetic coil should be disposed and with belt receiving grooves. Therefore, since the pulley is complex in the shape, it takes a long time to form the pulley. That is, the pulley is formed through a long forging process and is finished to accurate dimensions through a machining step. In the machining step, a large amount of material is removed. Therefore, in the known method for producing the pulley, much material is wasted. Thus, the cost of the electromagnetic clutch is increased.

In order to reduce the weight of the pulley, it has been made to constitute the pulley by two pieces of an annular body of magnetic materials such as steel and a belt receiving groove member of aluminum or aluminum alloy fixed on the outer surface of the annular body. The resultant pulley is light in the weight. However, the surface of the magnetic portion opposing the armature plate is reduced so that the rotation transmitting force may be reduced. In order to increase the surface of the magnetic portion opposing to the armature plate, it is used to form an annular rim radially projecting on the outer surface of the annular body at an axial end thereof opposing to the armature plate. Therefore, the magnetic annular body is relatively complex in the shape. Accordingly, if it is formed by forging following machining, the wasted material is still much. And if it is press-formed from an annular plate, a large amount of material must be removed by machining to form the radially projecting annular rim.

Furthermore, either a single part of pulley of magnetic material or an annular body as a part of the pulley must be provided with a stopper for a bearing on which the pulley should be mounted so that the shape of them is further complex.

SUMMARY OF THE INVENTION

It is an object of this invention to provide an improved method for producing a magnetic annular portion of a pulley or a magnetic rotatable member in an electromagnetic clutch.

It is another object of this invention to provide a simple method for producing the magnetic rotatable member in an electromagnetic clutch for a reduced producing time wherein the wasted material is reduced.

It is still another object of this invention to provide a method for easily producing the rotatable magnetic member with an accurate dimension.

It is yet another object of this invention to provide a method for producing the rotatable magnetic member in an electromagnetic clutch having an increased magnetic friction surface opposing to the armature plate.

According to this invention, a method for producing a magnetic rotatable member for an electromagnetic clutch having a cross section of a generally U-shaped form to define an annular hollow portion in which an electromagnetic coil should be disposed and having a stopper for a bearing means on which the rotatable member should be mounted. The method comprises steps of preparing a magnetic circular plate of a predetermined dimension, forming an annular blank from the circular plate by press-drawing process which has an outer annular cylindrical portion, an inner annular cylindrical portion, and an axial end annular plate portion connecting the outer and inner cylindrical portion at their axial ends, ironing the annular blank at the outer surface of the outer annular cylindrical portion to form a radially projecting annular rim on the outer surface at the axial end so that the axial end surface is arranged with the axial end surface of the axial end annular plate portion, cutting away an outer edge portion of the inner annular cylindrical portion at the other axial end to form an annular thin wall portion, and press-bending the thin wall portion radially inwardly to form the stopper for the bearing.

The annular blank may be formed by press-drawing the circular plate into the annular blank wherein the inner surface of the outer annular cylindrical portion is tapered so that the thickness gradually increases towards the axial end annular plate portion and bending the outer annular cylindrical portion radially inwardly before the ironing step so that the inner surface of the outer annular cylindrical portion is perpendicular to the axial end annular plate portion.

The annular blank is also formed by press-drawing the circular plate to form a cup like member, and reverse-drawing the cup-like member to form the annular blank.

Further objects, features and other aspects of this invention will be understood from the following detailed description of the preferred embodiments of this invention referring to the annexed drawings.

DETAILED DESCRIPTION OF PREFERRED EMBODIMENTS

Prior to the description of embodiments of this invention, examples of known electromagnetic clutches will be described referring to drawings.

Figure 1:
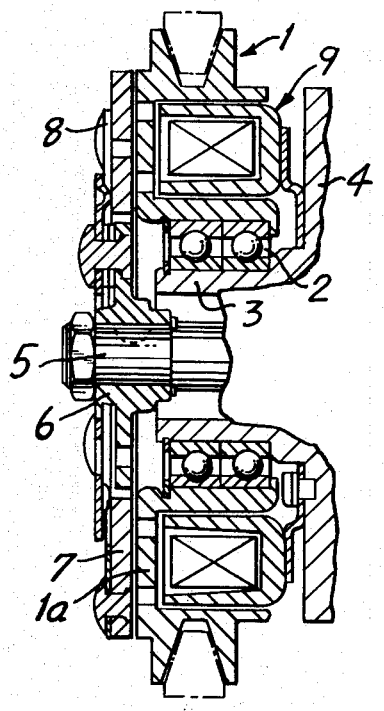
FIG. 1 (PRIOR ART)
FIG. 1 is a cross-sectional view of a known electromagnetic clutch.

Referring to FIG. 1, a known electromagnetic clutch which is used between the engine and the compressor for selectively driving the compressor includes a pulley 1 which is mounted on a bearing 2 mounted on a tubular extension 3 of a compressor housing 4. Pulley 1 is rotated by a belt shown by a dotted line from the automobile engine (not shown), and is provided with a plurality of concentric annular magnetic pole faces 1*a* at an axial end thereof. A drive shaft 5 of the compressor extends through tubular extension 3. A hub 6 is fixed to the extending terminal end of drive shaft 5, and an annular armature plate 7 is joined by leaf springs 8 to hub 6 so that armature plate faces the annular concentric pole faces with an axial space therebetween. An electromagnet 9 is mounted on tubular extension 3, and is stationarily disposed within an annular hollow portion formed in pulley 1 to supply magnetic flux for attracting armature plate to magnetic pole faces 1*a*.

Thus, when electromagnet 9 is energized, drive shaft 5 is rotated together with pulley 1 by the engine output, and when electromagnet 9 is not energized, pulley 1 is rotated by the engine but the compressor is not driven.

In this known electromagnetic clutch, the pulley has been formed as a single body of magnetic material such as steel by forging followed by machining. However, the pulley has several disadvantages in the weight and the production method as previously described.

Figure 2:
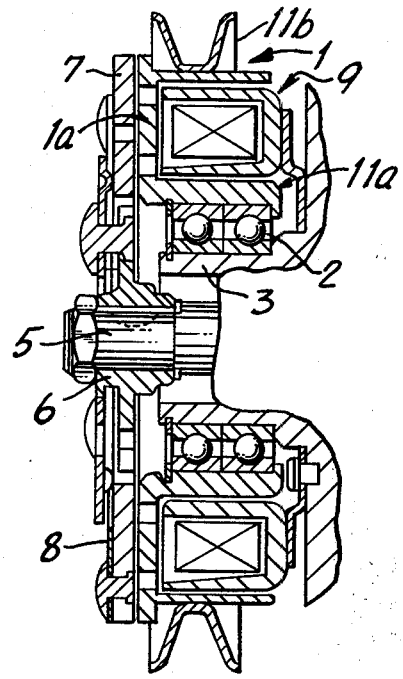
FIG. 2 (PRIOR ART)
FIG. 2 is a cross-sectional view of another known electromagnetic clutch.

Referring to FIG. 2, another known method of producing the pulley is to separately produce an annular magnetic main body 11*a* and an annular V-groove member 11*b* by a press-forming method, both of which are welded to one another after the main body 11*a* is fitted into the annular V-groove member 11*b*. In this method, the axial end magnetic friction surface is reduced, as previously described. In order to increase the surface, a radially projecting annular rim is formed on the outer surface of the annular magnetic main body at the axial end opposing the armature plate, as shown in FIG. 3.

Figure 3:
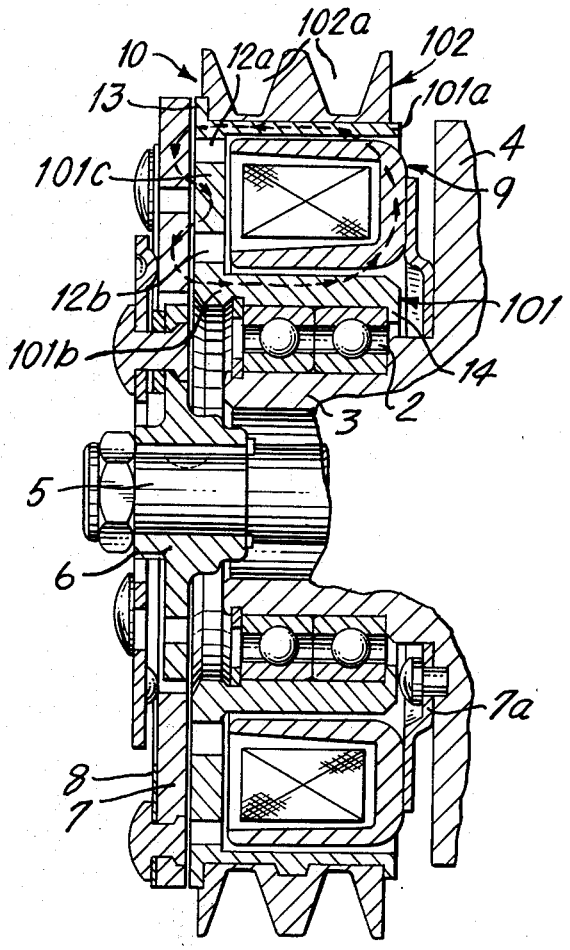
FIG. 3 is a cross-sectional view of the other known electromagnetic clutch.

Referring to FIG. 3, pulley 10 includes an annular magnetic body 101 of magnetic material such as steel and an annular belt-receiving groove member 102. Annular magnetic body 101 comprises an outer annular cylindrical portion 101*a*, an inner annular cylindrical portion 101*b* and an axial end annular plate portion 101*c* connecting the outer and inner annular cylindrical portions 101*a* and 101*b*. An annular hollow portion is defined by these three portions 101*a*–101*c* to stationarily contain electromagnet 9. Axial end annular plate portion 101*c* is provided with concentric slits 12*a* and 12*b* to form concentric annular magnetic pole faces at an axial end thereof. An annular rim 13 is formed to radially project on the outer surface of outer annular cylindrical portion 101*a* at the axial end thereof opposing to armature plate 7. Inner annular cylindrical portion 101*b* is provided with a radial flange or stopper 14 for bearing 2 at the axial end opposite to axial end annular plate portion 101*c*. Belt-receiving groove member 102 is formed with belt-receiving V-grooves 102*a* on the radial outer surface of annular magnetic body 101 by aluminum or aluminum alloy die casting.

This construction is similar to that proposed in a copending patent application filed on May 8, 1979 under Ser. No. 037,237 by the same assignee.

Figure 4A:
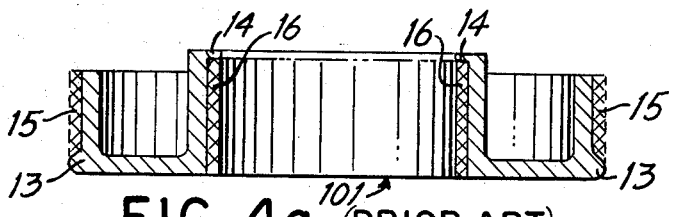
FIG. 4a (PRIOR ART)
FIGS. 4*a* and 4*b* are cross-sectional views of magnetic rotatable members for explaining different known producing methods of the rotatable magnetic member.
Figure 4B:
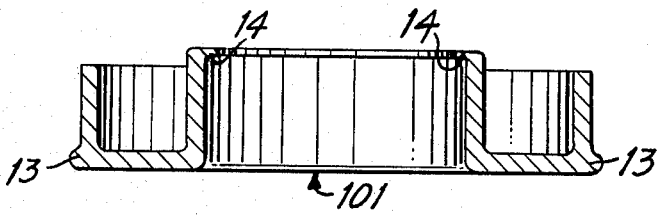
FIG. 4b (PRIOR ART)

In the arrangement in FIG. 3, even if magnetic annular body 101 is formed by pressing, machining must be carried out to form the annular rim and the radial flange. That is, after pressing, the material of the pressed body must be partially machined out as shown at 15 and 16 in FIG. 4*a* to form annular rim 13 and radial flange or stopper 14 for bearing. Therefore, the wasted material amount is not so reduced. Alternatively, magnetic annular body 101 can be formed by forging with annular rim 13 and radial flange 14, as shown in FIG. 4*b*. However, machining is also required to obtain the accurate dimension after forging. Therefore, the wasted material amount is still large.

This invention aims to an improved method for producing the magnetic annular body with the annular rim and the radial flange wherein the wasted material is remarkably reduced. The method of this invention is characterised by the use of press-drawing, ironing, bending and cutting.

An embodiment of this invention will be described referring to FIGS. 5*a*–5*e*.

Figure 5A:
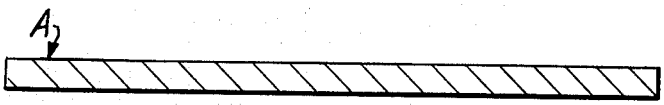
FIGS. 5*a*–5*e* are cross-sectional views of the magnetic rotatable member at different producing steps of an embodiment of this invention.

At first a magnetic circular plate A of a predetermined dimension is prepared, as shown in FIG. 5*a*. As to the magnetic material used, any magnetic material can be used if it is able to be subjected to drawing, ironing and bending. A desired example of such material is hot-rolled mild steel plate SPHE in JIS (Japanese Industrial Standard) G3131 (which comprises by weight up to 0.030% P, up to 0.035% S, up to 0.10% C, up to 0.5% Mn and the balance Fe).

Figure 5B:
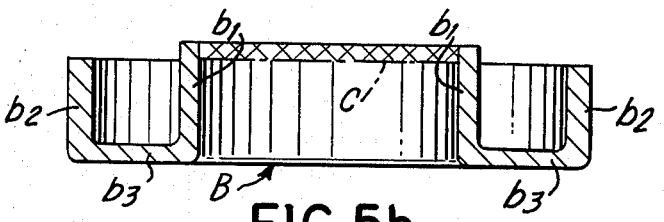

Magnetic circular plate A is subjected to press-drawing to form an annular blank B which comprises an inner annular cylindrical portion $b_1$, an outer annular cylindrical portion $b_2$ and an axial end annular plate portion $b_3$, as shown in FIG. 5*b*. The center portion shown by a cross-hatched region c is punched out at the last step of the press-drawing process.

If such a punching die is not combined with drawing dies, the plate A may be subjected to punching to remove the central portion corresponding to the portion c in FIG. 5*b*, before or after press-drawing.

Figure 5C:
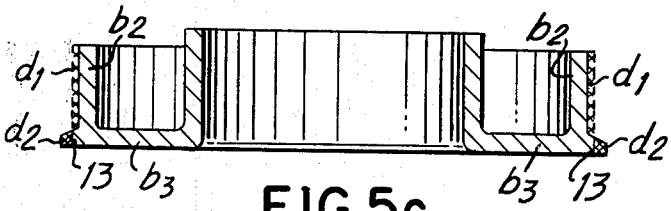
Figure 5D:
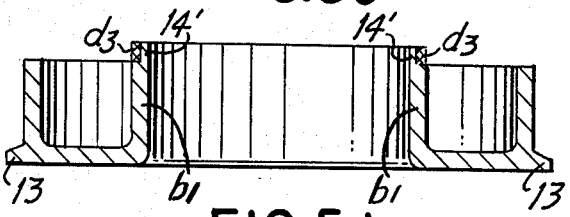

Thereafter, blank B is subjected to ironing to move the material of the surface layer of outer annular cylindrical portion $b_2$ to the axial end at a side of annular plate portion $b_3$, so that annular rim 13 is formed on outer annular cylindrical portion $b_2$ at the axial end, as shown in FIG. 5*c*. The material portion removed from outer surface of the outer annular cylindrical portion $b_2$ is shown by a cross-hatched region $d_1$, and the moved material to form annular rim 13 is shown by another cross-hatched region $d_2$.

Figure 5E:
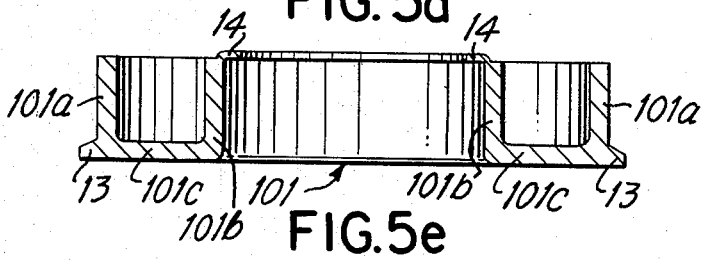

Blank B is also subjected to cutting process to cut away an outer edge portion of inner annular cylindrical portion $b_1$ to form an annular thin portion 14' at the axial end of inner annular cylindrical portion $b_1$. The cut away portion is shown by a cross-hatched portion $d_3$ in FIG. 5*d*. Thereafter, annular thin portion 14' is bent radially inwardly by bending process to form radial flange 14, as shown in FIG. 5*e*. Thus, annular magnetic body 101 is completed which comprises an outer annular cylindrical portion 101*a*, an inner annular cylindrical portion 101*b* and an axial end annular plate portion 101*c* connecting between both cylindrical portions at the axial end and having radial flange 14 and annular rim 13.

In the method of this embodiment, since the magnetic annular body is produced by drawing, ironing, cutting and pressing, it can be readily produced for the reduced producing time, and with a high accuracy of the dimension. Furthermore, since the cut-away material amount is quite little, the wasted material amount is remarkably reduced.

The ironing step may be performed after the cutting-away step and/or the bending process.

Another embodiment of this invention will be described referring to FIGS. 6*a*–6*c*.

Figure 6A:
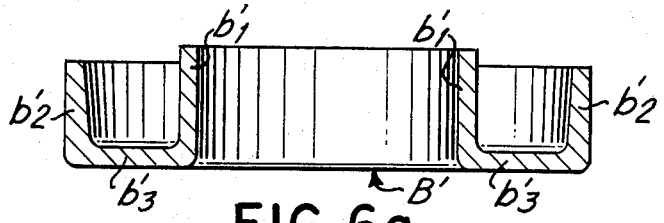
FIGS. 6*a*–6*c* are cross-sectional views of the magnetic rotatable member at different producing steps of another embodiment of this invention.

A magnetic circular plate (A in FIG. 5*a*) of a predetermined dimension is subjected to press-drawing to form an annular body B′ which comprises an inner annular cylindrical portion $b'_1$, an outer cylindrical portion $b'_2$, and an axial end annular plate portion $b'_3$, as shown in FIG. 6*a*. Blank B′ is characterised in that the inner surface of outer cylindrical portion $b'_2$ is formed tapered so that the thickness of outer cylindrical portion $b'_2$ is gradually increased towards axial end annular plate portion $b'_3$.

Blank B′ can be formed by a similar process or processes to the formation of blank B in the previous embodiment. But this embodiment is different from the previous embodiment in that the shape of a die defining the inner surface of the outer annular cylindrical portion is formed in a tapered surface consisting with the tapered inner surface of the cylindrical portion $b'_2$.

Blank B′ is, then, subjected to deforming or bending to bend outer annular cylindrical portion $b'_2$ radially inwardly at the connection with axial end annular plate portion $b'_3$, so that the inner surface of outer annular cylindrical portion $b'_2$ is perpendicular to the axial end annular plate portion $b'_3$. Therefore, the outer surface of outer annular cylindrical portion $b'_2$ is in a tapered form, as shown in FIG. 6*b*.

Figure 6B:
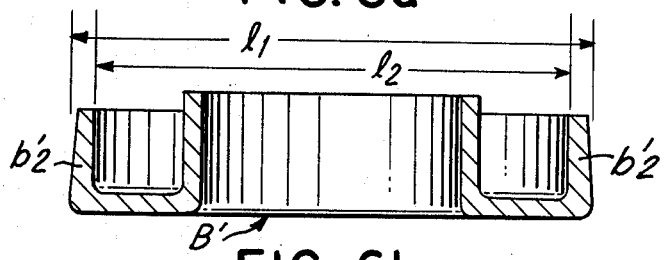
Figure 6C:
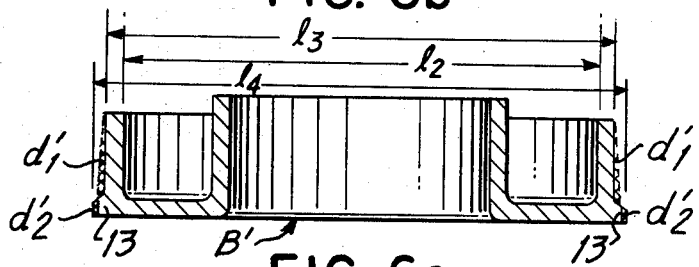

Blank B′, after bending, is subjected to ironing to form radial annular flange 13, as shown in FIG. 6*c*. The ironing is similar to that in the previous embodiment. However, since the outer surface of outer annular cylindrical portion $b'_2$ is tapered, the material amount removed from the outer surface of the annular portion $b'_2$ and, therefore, the moved amount to form annular rim 13 are less in comparison with the previous embodiment. The removed amount and the moved amount are shown at cross-hatched regions $d'_1$ and $d'_2$, respectively, in FIG. 6*c*.

In FIGS. 6*a*–6*c*, providing that the outer diameter of outer annular cylindrical portion $b'_2$ after press-drawing process is $l_1$, the inner diamter of outer annular cylindrical portion $b'_2$ after bending process being $l_2$, and the outer diameter of outer annular cylindrical portion $b'_2$ after bending being $l_3$, $l_1 > l_3 > l_2$. And the outer diameter and inner diameter of outer annular cylindrical portion $b'_2$ after ironing are $l_3$ and $l_2$, respectively, and the outer diameter of annular rim 13 is $l_4$ which is longer than $l_1$.

Therefore, this embodiment is easy in the ironing in comparison with the previous embodiment.

The formation of radial flange 14 is made similar to the previous embodiment, that is, by cutting away an outer edge portion of the inner annular cylindrical portion $b'_1$ and bending the resultant annular thin portion radially inwardly.

Figure 7A:
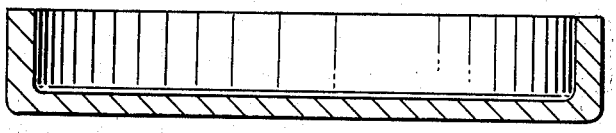
FIGS. 7*a* and 7*b* are cross-sectional views of the magnetic rotatable member at different producing method of a modified embodiment.
Figure 7B:
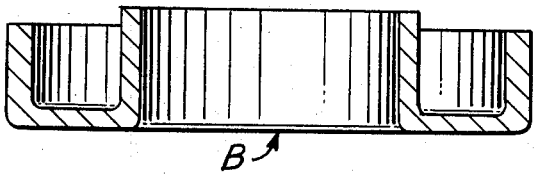

In order to form the blank B or B′, only one press-drawing process may be carried out as above described. But, depending on dies used, two processes of press-drawing are carried out. That is, a cup like blank is formed by a first press-drawing, as shown in FIG. 7*a*, and, then, the blank is subjected to a second press-drawing process or a reverse drawing to form the blank B or B′.

An aluminum or aluminum alloy belt receiving groove member is formed on an outer surface of the annular body of this invention by die-casting according to the above described copending patent application, so that the pulley is obtained.

As will be noted from above described embodiments, a compact and light magnetic rotatable member for an electromagnetic clutch having an increased magnetic friction surface area can be readily produced with a high accuracy of the dimension and without a reduced wasted material amount, according to this invention.

This invention has been described in detail in connection with preferred embodiments, but these are merely for example only and this invention is not restricted thereto. It will be easily understood by those skilled in the art that the other variations and modifications can be easily made within the scope of this invention.

What is claimed is:

1. A method for producing a magnetic rotatable member for an electromagnetic clutch having a cross section of a generally U-shaped form to define an annular hollow portion in which an electromagnetic coil should be disposed and having a stopper for a bearing means on which the rotatable member should be mounted, which comprises steps of:

preparing a magnetic circular plate of a predetermined dimension;

forming an annular blank from said circular plate by press-drawing process which has an outer annular cylindrical portion, an inner annular cylindrical portion, and an axial end annular plate portion connecting said outer and inner cylindrical portions at their axial ends;

ironing said annular blank at the outer surface of said outer annular cylindrical portion to form a radially projecting annular rim on the outer surface at the axial end so that the axial end surface is arranged with the axial end surface of said axial end annular plate portion;

cutting away an outer edge portion of said inner annular cylindrical portion at the other axial end to form an annular thin wall portion; and press-bending said thin wall portion radially inwardly to form said stopper for the bearing.

2. The method as claimed in claim 1, wherein said annular blank is formed by press-drawing said circular plate into said annular blank wherein the inner surface of said outer annular cylindrical portion is tapered so that the thickness gradually increases towards said axial end annular plate portion, and bending said outer annular cylindrical portion radially inwardly before said ironing step so that the inner surface of said outer annular cylindrical portion is perpendicular to said axial end annular plate portion.

3. The method as claimed in claim 1 or 2, wherein said annular blank is formed by press-drawing said circular plate to form a cup like member, and reverse-drawing said cup-like member to form said annular blank.

* * * * *